US005537817A

United States Patent [19]

Akazaki et al.

[11] Patent Number: 5,537,817

[45] Date of Patent: Jul. 23, 1996

[54] AIR-FUEL RATIO CONTROL SYSTEM FOR INTERNAL COMBUSTION ENGINES

[75] Inventors: Shusuke Akazaki; Hidetaka Maki; Kei Machida, all of Wako, Japan

[73] Assignee: Honda Giken Kogyo Kabushiki Kaisha, Tokyo, Japan

[21] Appl. No.: 452,980

[22] Filed: May 30, 1995

[30] Foreign Application Priority Data

Jun. 29, 1994 [JP] Japan ..... 6-170224

[51] Int. Cl.[6] ..... F01N 3/20

[52] U.S. Cl. ..... 60/276; 60/285

[58] Field of Search ..... 60/276, 285

[56] References Cited

U.S. PATENT DOCUMENTS 5,233,829 8/1993 Komatsu ..... 60/276

5,426,935 6/1995 Ogawa et al. ..... 60/276

FOREIGN PATENT DOCUMENTS 2-67443 3/1990 Japan .

5-321651 12/1993 Japan .

*Primary Examiner*—Leonard E. Heyman

*Attorney, Agent, or Firm*—Armstrong, Westerman, Hattori, McLeland & Naughton

[57] ABSTRACT

An air-fuel ratio control system for an internal combustion engine having first and second catalytic converters arranged in the exhaust passage comprises first to third exhaust gas component concentration sensors arranged in the exhaust passage, the first one being arranged upstream of the first catalytic converter, the second one at a location intermediate between the first and second catalytic converters, and the third one downstream of the second catalytic converter. An ECU carries out feedback control of the air-fuel ratio of a mixture supplied to the engine to a desired air-fuel ratio in response to an output from the first exhaust gas component concentration sensor. A first feedback control parameter for use in the feedback control is calculated, based on an output from the second exhaust gas component concentration sensor. A second feedback control parameter for use in the calculation of the first feedback control parameter is calculated, based on an output from the third exhaust gas component concentration sensor.

10 Claims, 13 Drawing Sheets

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system which controls the air-fuel ratio of a mixture supplied to the engine to a desired air-fuel ratio in a feedback manner based on outputs from a plurality of exhaust gas component concentration sensors arranged in the exhaust passage of the engine.

2. Prior Art

There are conventionally known air-fuel ratio control systems which are applied to an internal combustion engine which is provided with first and second exhaust gas-purifying catalytic converters serially arranged in the exhaust system at respective upstream and downstream locations, and first and second exhaust gas component concentration sensors arranged, respectively, at locations upstream and downstream of the first catalytic converter, and wherein feedback control of the air-fuel ratio of an air-fuel mixture to be supplied to the engine is carried out, based on outputs from these exhaust gas component concentration sensors to thereby improve exhaust emission characteristics of the engine, e.g. from Japanese Laid-Open Patent Publication (Kokai) No. 5-321651 (hereinafter referred to as "Prior Art 1") and Japanese Laid-Open Patent Publication (Kokai) No. 2-67443 (hereinafter referred to as "Prior Art 2").

According to Prior Art 1, the second exhaust gas component concentration sensor is arranged at a location intermediate the two catalytic converters in order to secure required responsiveness of the feedback control, which, however, results in incapability of monitoring final components present in exhaust gases downstream of the second catalytic converter, i.e. exhaust gases emitted from the engine into the air. On the other hand, according to Prior Art 2, the second exhaust gas component concentration sensor is arranged downstream of the second catalytic converter, and therefore final components present in exhaust gases emitted from the engine can be monitored. However, Prior Art 2 suffers from degraded responsiveness of the feedback control. Therefore, the prior art has room for further improvement in the purification of exhaust gases emitted from the engine.

SUMMARY OF THE INVENTION

It is the object of the invention to provide an air-fuel ratio control system for internal combustion engines provided with two catalytic converters arranged in the exhaust passage, which is capable of further improving exhaust emission characteristics of the engine.

To attain the above object, the present invention provides an air-fuel ratio control system for an internal combustion engine having an exhaust passage, first catalytic converter means arranged in the exhaust passage, for purifying exhaust gases emitted from the engine, and second catalytic converter means arranged in the exhaust passage at a location downstream of the first catalytic converter means, for purifying the exhaust gases, the system comprising:

first exhaust gas component concentration sensor means arranged in the exhaust passage at a location upstream of the first catalytic converter means, for detecting concentration of a specific component in the exhaust gases;

first feedback control means for carrying out feedback control of an air-fuel ratio of a mixture supplied to the engine to a desired air-fuel ratio in response to an output from the first exhaust gas component concentration sensor means;

second exhaust gas component concentration sensor means arranged in the exhaust passage at a location downstream of the first catalytic converter means and upstream of the second catalytic converter means, for detecting the concentration of the specific component in the exhaust gases;

second feedback control means for calculating a first feedback control parameter for use in the feedback control by the first feedback control means, based on an output from the second exhaust gas component concentration sensor means;

third exhaust gas component concentration sensor means arranged in the exhaust passage at a location downstream of the second catalytic converter means for detecting the concentration of the specific component in the exhaust gases; and third feedback control means for calculating a second feedback control parameter for use in the calculation of the first feedback control parameter by the second feedback control means, based on an output from the third exhaust gas component concentration sensor means.

Preferably, the air-fuel ratio control system includes inhibition condition-detecting means for detecting a predetermined condition in which use of the second exhaust gas component concentration sensor means is to be inhibited, and wherein the second feedback control means is responsive to a result of detection by the inhibition condition-detecting means that the predetermined condition is fulfilled, for replacing the output from the second exhaust gas component concentration sensor means by the output from the third exhaust gas component concentration sensor means, to calculate the first feedback control parameter, based thereon.

More preferably, the air-fuel ratio control system also includes interruption means responsive to the result of detection by the inhibition condition-detecting means that the predetermined condition is fulfilled, for interrupting operation of the third feedback control means.

Preferably, the predetermined condition comprises at least one of conditions that the second exhaust gas component concentration sensor means is in an abnormal state, the second exhaust gas component concentration sensor means is not activated, and a predetermined time period has not elapsed after the second exhaust gas component concentration sensor means has become activated.

Also preferably, the first feedback control parameter corresponds to the desired air-fuel ratio (KCMDM).

Alternatively, the first feedback control parameter is a feedback gain (KLAFFP, KLAFFI, KLAFFD) used in the feedback control by the first feedback control means.

Preferably, the second feedback control parameter is a reference output (VRREFM) to be compared with the output from the second exhaust gas component concentration sensor means to determine the desired air-fuel ratio (KCMDM).

Alternatively, the second feedback control parameter is a control gain (KVPM, KVIM, KVDM) used in the calculation of the first feedback control parameter by the second feedback control means.

The above and other objects, features, and advantages of the invention will become more apparent from the ensuing detailed description taken in conjunction with the accompanying drawings.

DETAILED DESCRIPTION

The invention will now be described in detail with reference to the drawings showing an embodiment thereof.

Figure 1:
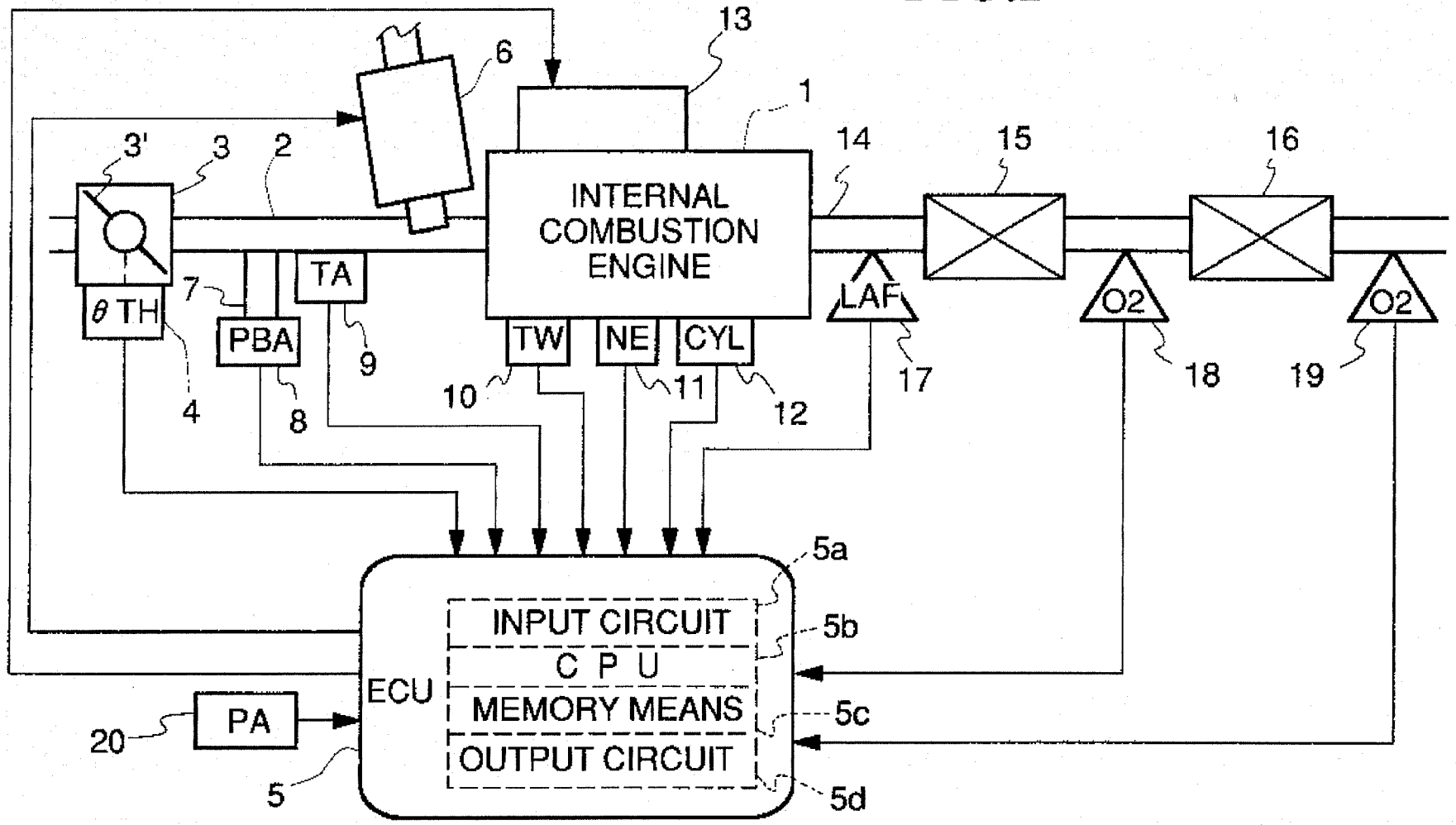
FIG. 1 is a block diagram schematically showing the arrangement of an internal combustion engine and an air-fuel ratio control system therefor, according to an embodiment of the invention.

Referring first to FIG. 1, there is schematically illustrated the arrangement of an internal combustion engine and an air-fuel ratio control system therefor, according to an embodiment of the invention.

In the Figure, reference numeral 1 designates a DOHC straight type four-cylinder engine (hereinafter simply referred to as "the engine"), each cylinder being provided with a pair of intake valves, not shown, and a pair of exhaust valves, not shown. Connected to the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening and supplying the same to an electronic control unit (hereinafter referred to as "the ECU") 5.

Fuel injection valves 6, only one of which is shown, are inserted into the interior of the intake pipe 2 at locations intermediate the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

Further, an intake pipe absolute pressure (PBA) sensor 8 is provided in communication with the interior of the intake pipe 2 via a conduit 7 opening into the intake pipe 2 at a location downstream of the throttle valve 3' for supplying an electric signal indicative of the sensed absolute pressure within the intake pipe 2 to the ECU 5.

An intake air temperature (TA) sensor 9 is inserted into the intake pipe 2 at a location downstream of the conduit 7 for supplying an electric signal indicative of the sensed intake air temperature TA to the ECU 5.

An engine coolant temperature (TW) sensor 10 formed of a thermistor, or the like, is inserted into a coolant passage filled with a coolant and formed in the cylinder block, for supplying an electric signal indicative of the sensed engine coolant temperature TW to the ECU 5.

An engine rotational speed (NE) sensor 11 and a cylinder-discriminating (CYL) sensor 12 are arranged in facing relation to a camshaft or a crankshaft of the engine 1, neither of which is shown.

The NE sensor 11 generates a pulse as a TDC signal pulse at each of predetermined crank angles whenever the crankshaft rotates through 180 degrees, while the CYL sensor 12 generates a pulse at a predetermined crank angle of a particular cylinder of the engine, both of the pulses being supplied to the ECU 5.

Each cylinder of the engine 1 has a spark plug 13 electrically connected to the ECU 5 to have its ignition timing controlled by a signal therefrom.

First and second catalytic converters 15 and 16 are serially arranged in an exhaust pipe 14 connected to the cylinder block of the engine 1, in this order from the upstream side of the exhaust pipe 14, for purifying noxious components in exhaust gases from the engine, such as HC, CO, and NOx.

A linear oxygen concentration sensor (hereinafter referred to as "the LAF sensor") 17 as a first exhaust gas component concentration sensor is arranged in the exhaust pipe 14 at a location upstream of the first catalytic converter 15. Further, a first oxygen concentration sensor (hereinafter referred to as "the MO2 sensor") 18 as a second exhaust gas component concentration sensor is arranged in the exhaust pipe 14 at a location intermediate between the first and second catalytic converters 15 and 16, and a second oxygen concentration sensor (hereinafter referred to as "the RO2 sensor") 19 as a third exhaust gas component concentration sensor, at a location downstream of the second catalytic converter 16, respectively.

The LAF sensor 17 is comprised of a sensor element formed of a solid electrolytic material of zirconia (ZrO) and having two pairs of cell elements and oxygen pumping elements mounted at respective upper and lower locations thereof, and an amplifier circuit is electrically connected thereto. The LAF sensor 17 generates and supplies the ECU 5 with an electric signal, an output level of which is substantially proportional to the oxygen concentration in exhaust gases flowing through the sensor element.

The M02 sensor 18 and the RO2 sensor 19 are also formed of a solid electrolytic material of zirconia (ZrO) like the LAF sensor 17 and having a characteristic that an electromotive force thereof drastically changes as the air-fuel ratio of exhaust gases changes across a stoichiometric value, so that an output therefrom is inverted from a lean value-indicating signal to a rich value-indicating signal, or vice versa as the air-fuel ratio of the exhaust gases changes across the stoichiometric value. More specifically, the O2 sensors 18 and 19 generate high level signals when the air-fuel ratio of exhaust gases is rich, and low level signals when it is lean. The output signals from the O2 sensors 18 and 19 are supplied to the ECU 5.

An atmospheric pressure (PA) sensor 20 is arranged at a suitable portion of the engine for supplying the ECU 5 with an electric signal indicative of the atmospheric pressure PA sensed thereby.

The ECU 5 is comprised of an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* formed of a ROM storing various operational programs which are executed by the CPU 5*b*, and various maps and tables, referred to hereinafter, and a RAM for storing results of calculations therefrom, etc., and an output circuit 5*d* which outputs driving signals to the fuel injection valves 6 and the spark plugs 13.

The CPU 5*b* operates in response to signals from various sensors, as mentioned above, to determine operating conditions in which the engine 1 is operating, such as an air-fuel ratio feedback control region in which air-fuel ratio control is carried out in response to oxygen concentration in exhaust gases, and open-loop control regions, and calculates, based upon the determined engine operating conditions, a fuel injection period TOUT for each of the fuel injection valves 6, in synchronism with generation of TDC signal pulses, by the use of the following equation (1) when the engine is in a basic operating mode, and by the use of the following equation (2) when the engine is in a starting mode, and stores results of calculation into the memory means 5*c* (RAM):

$$TOUT=TiM\times KCMDM\times KLAF\times K1+K2 \quad (1)$$

$$TOUT=TiCR\times K3+K4 \quad (2)$$

where TiM represents a basic fuel injection period used when the engine is in the basic operating mode, which, specifically, is determined according to the engine rotational speed NE and the intake pipe absolute pressure PBA. A TiM map used for determining the TiM value is stored in the memory means 5*c* (ROM).

TiCR represents a basic fuel injection period used when the engine is in the starting mode, which is determined according to the engine rotational speed NE and the intake pipe absolute pressure PBA, similarly to the TiM value. A TiCR map used for determining the TiCR value is stored in the memory means 5*c* (ROM), as well.

KCMDM represents a modified desired air-fuel ratio coefficient, which is set based on a desired air-fuel ratio coefficient KCMD determined based on operating conditions of the engine, and an air-fuel ratio correction value ΔKCMD determined based on an output from the MO2 sensor 18, as will be described later.

KLAF represents an air-fuel ratio correction coefficient, which is set during the air-fuel ratio feedback control such that the air-fuel ratio detected by the LAF sensor 17 becomes equal to a desired air-fuel ratio set by the KCMDM value, and set during the open-loop control to predetermined values depending on operating conditions of the engine.

K1 and K3 represent other correction coefficients and K2 and K4 represent correction variables. The correction coefficients and variables are set depending on operating conditions of the engine to such values as will optimize operating characteristics of the engine, such as fuel consumption and engine accelerability.

Next, description will be made of a manner of carrying out the air-fuel ratio feedback control by the CPU 5*b* according to the present embodiment.

Figure 2:
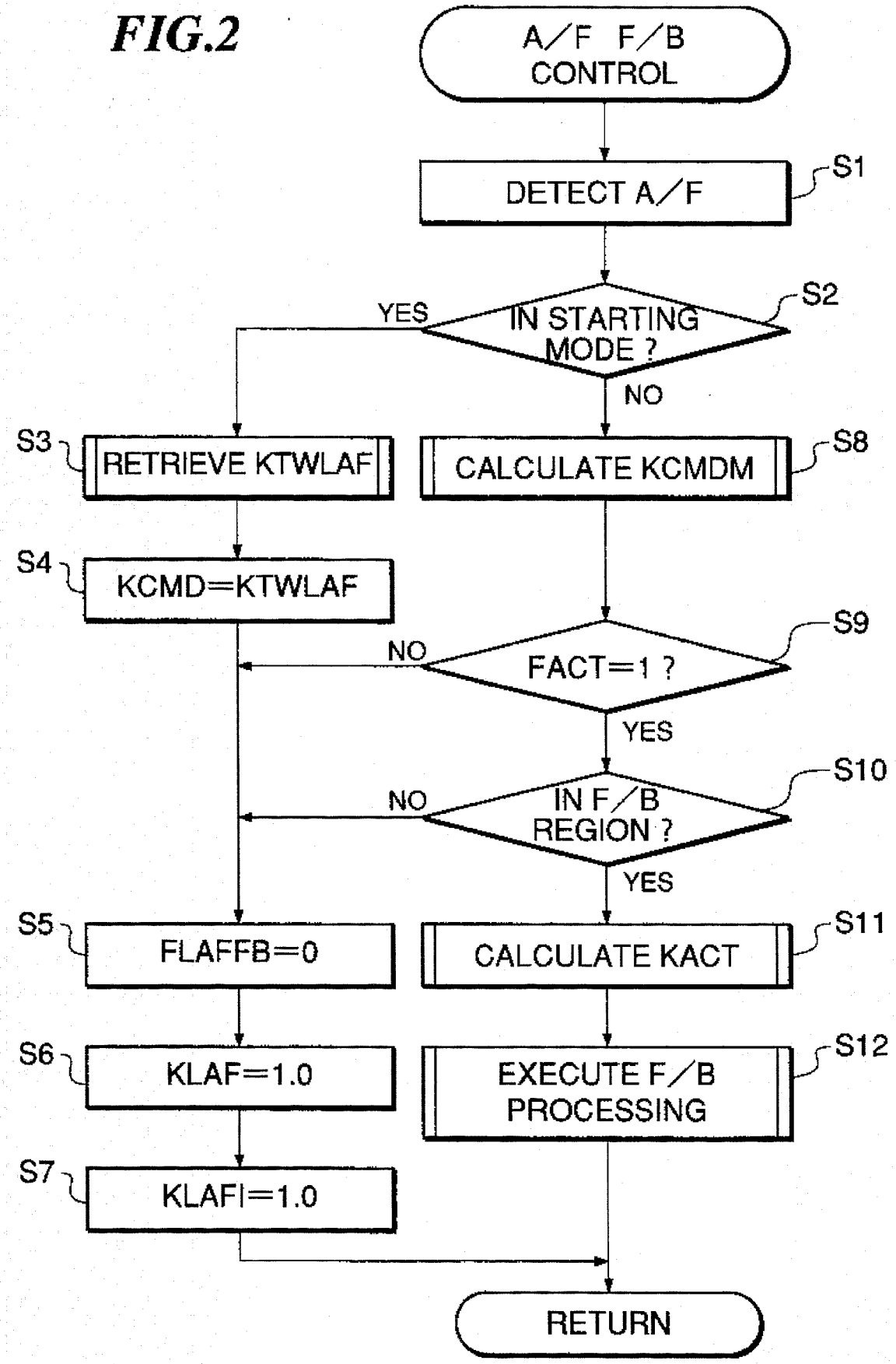
FIG. 2 is a flowchart showing a main routine for carrying out air-fuel ratio feedback control of a mixture supplied to the engine.

FIG. 2 shows a main routine for carrying out the air-fuel ratio feedback control.

First, at a step S1, an output value from the LAF sensor 17 is read in. Then, at a step S2, it is determined whether or not the engine is in the starting mode. The determination as to the starting mode is carried out by determining whether or not a starter switch, not shown, of the engine has been closed and at the same time the engine rotational speed NE is below a predetermined value (cranking speed).

If the answer at the step S2 is affirmative (YES), i.e. if the engine is in the starting mode, generally the engine coolant temperature is low, and therefore a desired air-fuel ratio coefficient KTWLAF suitable for low engine coolant temperature is determined at a step S3 by retrieving a KTWLAF map according to the engine coolant temperature TW and the intake pipe absolute pressure PBA. The determined KTWLAF value is set to the desired air-fuel ratio coefficient KCMD at a step S4. Then, a flag FLAFFB is set to "0" at a step S5 to inhibit execution of the air-fuel ratio feedback control, and the air-fuel ratio correction coefficient KLAF and an integral term (I term) KLAFI thereof are set to 1.0 at respective steps S6 and S7, followed by terminating the program.

On the other hand, if the answer at the step S2 is negative (NO), i.e. if the engine is in the basic operating mode, the modified desired air-fuel ratio coefficient KCMDM is determined at a step S8 according to a KCMDM-determining routine, described hereinafter with reference to FIG. 3, and then it is determined at a step S9 whether or not a flag FACT is set to "1" to determine whether or not the LAF sensor 17 has been activated. The determination as to whether the LAF sensor 17 has been activated is carried out according to an LAF sensor activation-determining routine, not shown, which is executed as background processing. For example, according to the routine, when the difference between an output voltage value VOUT from the LAF sensor 17 and a predetermined central voltage value VCENT thereof is smaller than a predetermine value (e.g. 0.4 V), it is determined that the LAF sensor 17 has been activated.

If the answer at the step S9 is negative (NO), the program proceeds to the step S5, whereas if the answer is affirmative (YES), i.e. if the LAF sensor 17 has been activated, it is determined at a step S10 whether or not the engine is operating in a region where feedback control is to be carried out based on an output from the LAF sensor 17. If the answer is negative (NO), the program proceeds to the step S5, whereas if the answer is affirmative (YES), the program proceeds to a step S11, wherein an equivalent ratio KACT (14.7/(A/F)) of the air-fuel ratio (hereinafter referred to as "the detected air-fuel ratio coefficient") detected by the LAF sensor 17 is calculated. The detected air-fuel ratio coefficient KACT is calculated to a value which is corrected based on the intake pipe absolute pressure PBA, the engine rotational speed NE, and the atmospheric pressure PA, in view of the fact that the pressure of exhaust gases varies with these operating parameters of the engine. Specifically, the detected air-fuel ratio coefficient KACT is determined by executing a KACT-calculating routine, not shown.

Then, at a step S12, a feedback processing routine is executed, followed by terminating the program.

Figure 3:
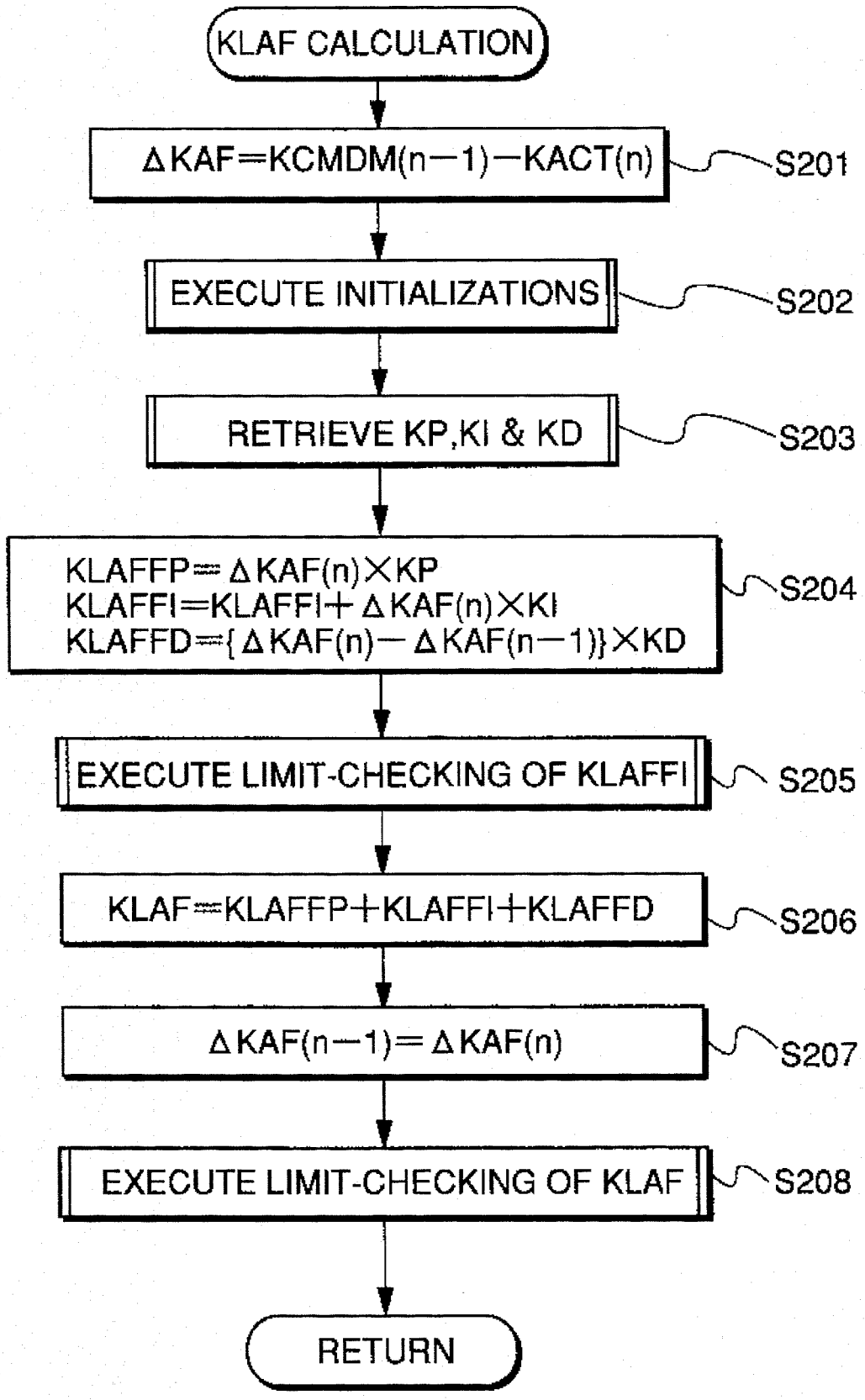
FIG. 3 is a flowchart showing a subroutine for calculating an air-fuel ratio correction coefficient KLAF, which is executed by the FIG. 2 routine.

FIG. 3 shows a KLAF-determining routine which is executed at the step S12 in FIG. 2, in synchronism with generation of TDC signal pulses.

First, at a step S201, a calculation is made of a value of the difference ΔKAF between a modified desired air-fuel ratio coefficient KCMDM(n−1) determined in the preceding loop and a detected air-fuel ratio coefficient KACT(n) determined in the present loop.

At a step S2O2, initializations of the air-fuel ratio correction coefficient KLAF, etc. are executed. More specifically, the air-fuel ratio correction coefficient KLAF, etc. are initialized according to an initialization routine, not shown, based on the operating condition of the engine.

Then, at a step S203, a KP map, a KI map, and a KD map, none of which is shown, are retrieved to determine a rate of change in the air-fuel ratio feedback control, i.e. a proportional term (P term) coefficient KP, an integral term (I term) coefficient KI, and a differential term (D term) coefficient KD, respectively. The KP map, KI map, and KD map are set such that predetermined map values for the respective term coefficients are provided in a manner corresponding to regions defined by predetermined values of the engine rotational speed NE, the intake pipe absolute pressure PBA, etc. By retrieving these maps, map values suitable for the engine operating condition are determined, or additionally by interpolation, if required. Each of the KP, KI and KD maps consists of a plurality of maps stored in the memory means 5c (ROM) to be selected for exclusive use in respective different operating conditions of the engine, such as a normal operating condition, a transient operating condition, and a decelerating condition, depending on which of these operating conditions the engine is operating in, so that the optimal map values can be obtained.

Then, at a step S204, calculations are made of a P term KLAFFP, an I term KLAFFI, and a D term KLAFFD, by the use of the following respective equations (3) to (5):

$$KLAFFP=\Delta KAF\ (n)\times KP \quad (3)$$

$$KLAFFI=KLAFFI+\Delta KAF\ (n)\times KI \quad (4)$$

$$KLAFFD=(AKAF(n)-\Delta KAF\ (n-1))\times KD \quad (5)$$

At a step S205, limit-checking of the I term KLAFFI calculated as above is executed. More specifically, the KLAFFI value is compared with predetermined upper and lower limit values LAFFIH and LAFFIL, and if the KLAFFI value is larger than the upper limit value LAFFIH, the KLAFFI value is set to the upper limit value LAFFIH, whereas if the KLAFFI value is smaller than the lower limit value LAFFIL, the KLAFFI value is set to the lower limit value LAFFIL.

At a step S206, the air-fuel ratio correction coefficient KLAF is calculated by adding together the P term KLAFFP, the I term KLAFFI, and the D term KLALFFD, and then at a step S207, a value ΔKLAF(n) of the difference ΔKLAF calculated in the present loop is set to a value ΔKLAF(n−1) value calculated in the last loop.

Then, at a step S208, limit-checking of the KLAF value calculated as above is executed, followed by terminating the present program.

The rate of execution of the present program may be thinned out depending on operating conditions of the engine, if required, such that the KLAF value is updated once per generation of several TDC signal pulses.

Figure 4:
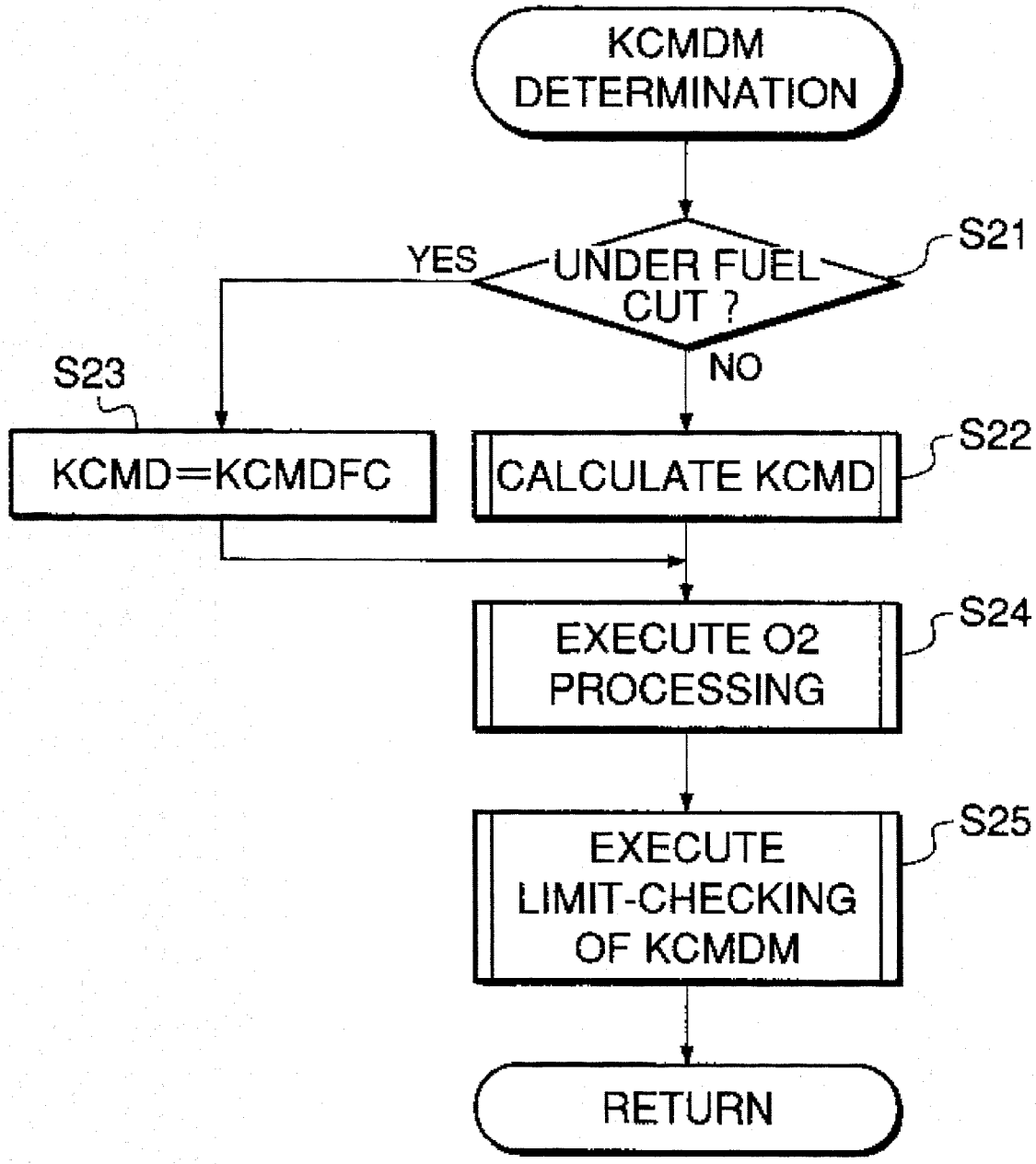
FIG. 4 is a flowchart showing a subroutine for determining a modified desired air-fuel ratio coefficient KCMDM, which is executed by the FIG. 2 routine.

FIG. 4 shows details of the aforementioned KCMDM-determining routine which is executed at the step S8 in FIG. 2, in synchronism with generation of TDC signal pulses.

First, it is determined at a step S21 whether or not the engine is under fuel cut, i.e. fuel supply is interrupted. The determination as to fuel cut is carried out based on the engine rotational speed NE and the valve opening θTH of the throttle valve 3', and more specifically determined by a fuel cut-determining routine, not shown.

If the answer at the step S21 is negative (NO), i.e. if the engine is in the basic operating mode, the program proceeds to a step S22, wherein the desired air-fuel ratio coefficient KCMD is determined. The desired air-fuel ratio coefficient KCMD is normally read from a KCMD map according to the engine rotational speed NE and the intake pipe absolute pressure PBA, which map is set such that predetermined KCMD map values are provided correspondingly to predetermined values of the engine rotational speed NE and those of the intake pipe absolute pressure PBA. At standing start of a vehicle with the engine installed thereon, or when the engine coolant temperature is low, or when the engine is in a predetermined high load condition, the map value read is corrected to a suitable value, specifically by executing a KCMD-determining routine, not shown. The program then proceeds to a step S24.

On the other hand, if the answer at the step S21 is affirmative (YES), the desired air-fuel ratio coefficient KCMD is set to a predetermined value KCMDFC (e.g. 1.0) at a step S23, and then the program proceeds to the step S24.

At the step S24, O2 processing is executed. More specifically, the desired air-fuel ratio coefficient KCMD is corrected based on the output from the MO2 sensor 18 to obtain the modified desired air-fuel ratio coefficient KCMDM, under predetermined conditions, as will be described hereinafter.

Then, at a step S25, limit-checking of the modified desired air-fuel ratio coefficient KCMDM calculated as above is carried out, followed by terminating the present subroutine to return to the main routine of FIG. 2. More specifically, the KCMDM value calculated at the step S24 is compared with predetermined upper and lower limit values KCMDMH and KCMDML, and if the KCMDM value is larger than the predetermined upper limit value KCMDMH, the former is set to the latter, whereas if the KCMDM value is smaller than the predetermined lower limit value KCMDML, the former is set to the latter.

Figure 5:
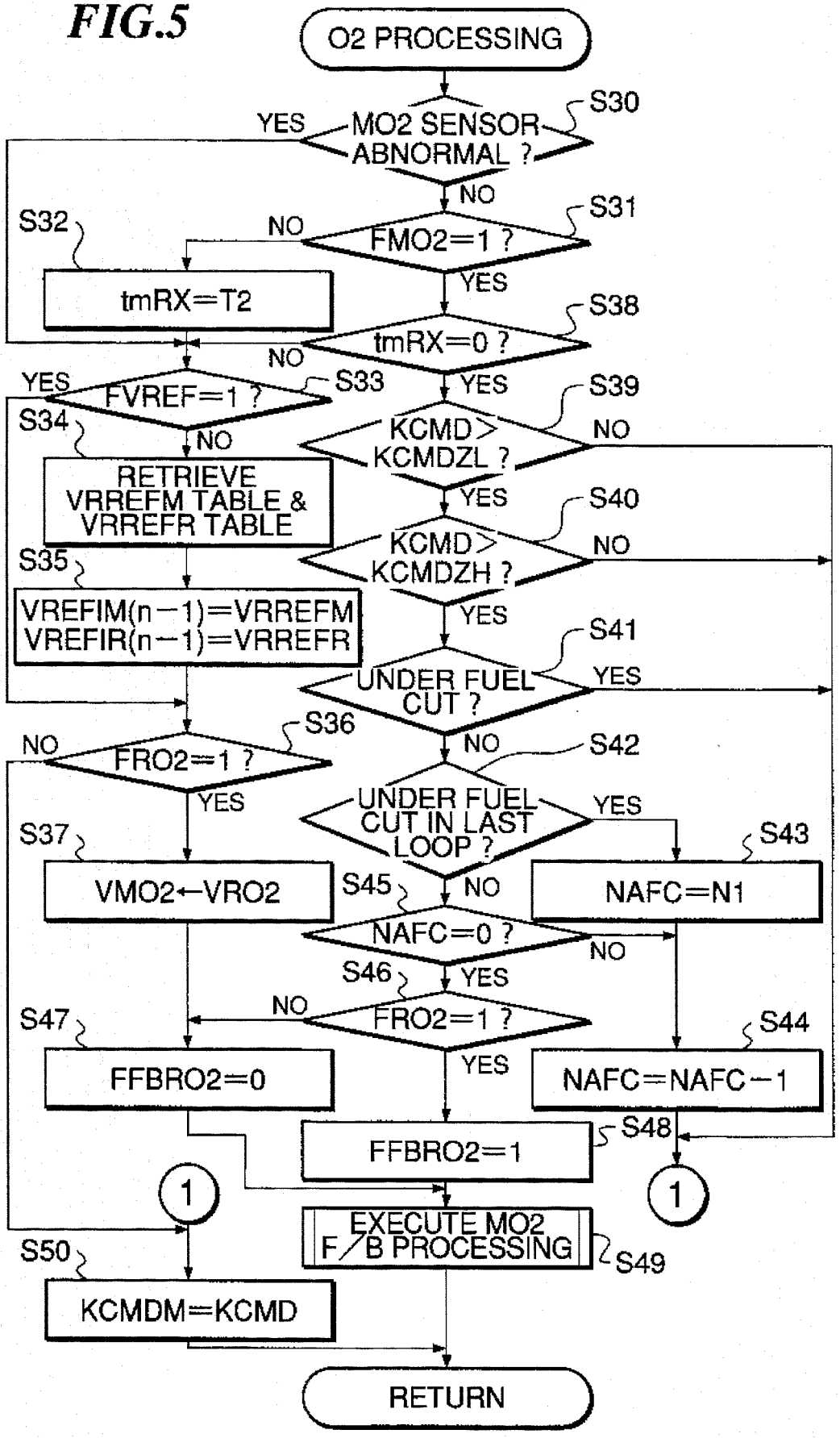
FIG. 5 is a flowchart showing a subroutine for carrying out 02 processing, which is executed by the FIG. 4 routine.

FIG. 5 shows an O2 processing routine which is executed at the step S24 in FIG. 4, in synchronism with generation of TDC signal pulses.

First, it is determined at a step S30 whether or not an abnormality of the MO2 sensor 18 has been detected, and if an abnormality has been detected, the program jumps to a step S33. On the other hand, if no abnormality has been detected, it is determined at a step S31 whether or not a flag FMO2 is set to "1", to determine whether or not the MO2 sensor 18 has been activated. The determination as to activation of the MO2 sensor 18 is carried out, specifically by executing an MO2 sensor activation-determining routine shown in FIG. 6, as background processing.

Figure 6:
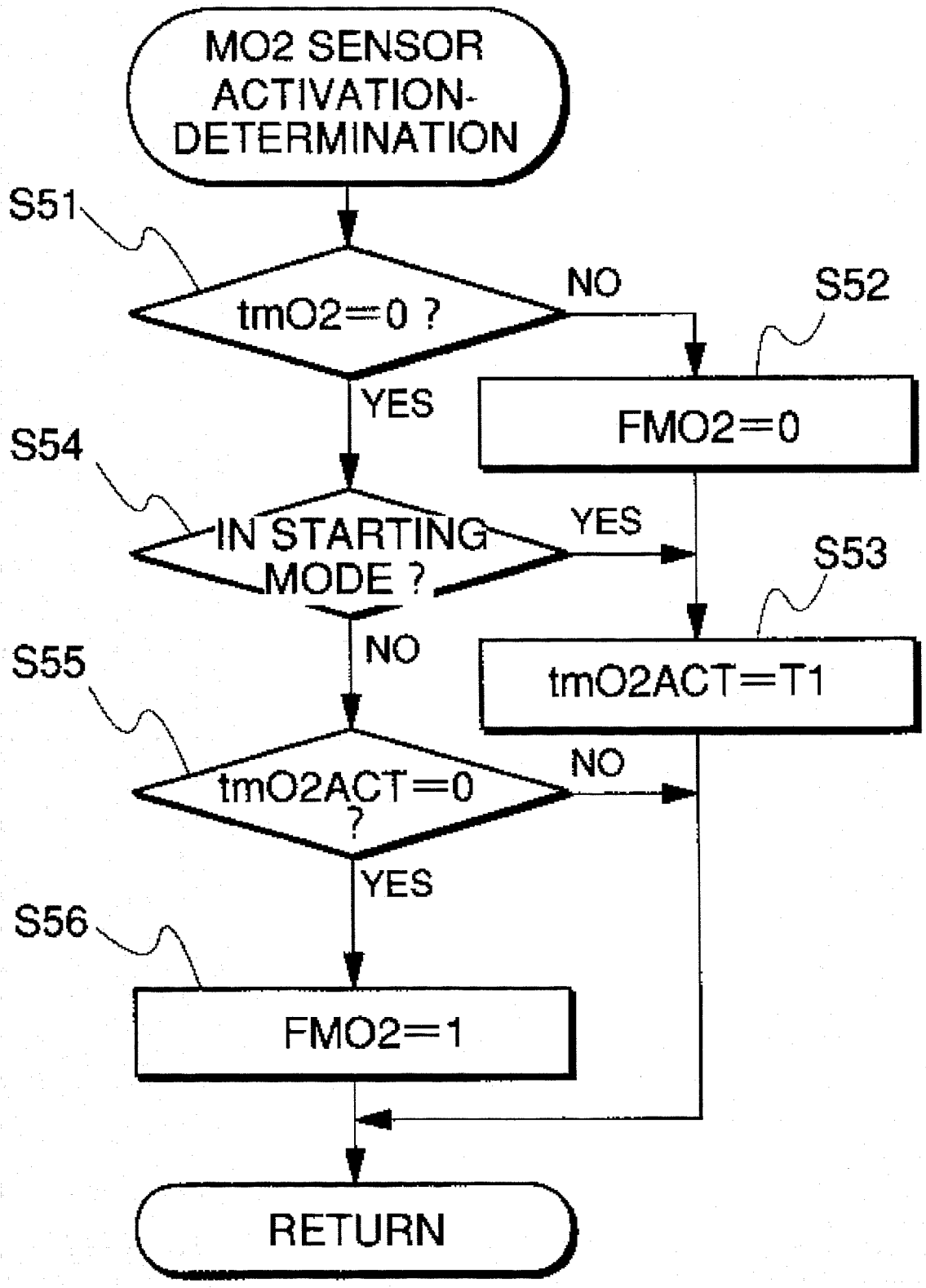
FIG. 6 is a flowchart showing an MO2 sensor activation-determining routine, which is executed by the FIG. 5 routine.

Referring to FIG. 6, first it is determined at a step S51 whether or not the count value of an activation-determining timer tmO2, which is set to a predetermined value (e.g. 2.56 sec.) when an ignition switch, not shown, of the engine is turned on, is equal to "0". If the answer is negative (NO), it is judged that the MO2 sensor 18 has not been activated yet, and then the flag FMO2 is set to "0" at a step S52, and an O2 sensor forcible activation timer tmO2ACT is set to a predetermined value T1 (e.g. 2.56 sec.) and started, at a step S53, followed by terminating the program.

On the other hand, if the answer at the step S51 is affirmative (YES), it is determined at a step S54 whether or not the engine is in the starting mode. If the answer is affirmative (YES), the program proceeds to the step S53, wherein the forcible activation timer tmO2ACT is set to the predetermined value T1 and started, followed by terminating the program.

If the answer at the step S54 is negative (NO), the program proceeds to a step S55, wherein it is determined whether or not the count value of the forcible activation timer tmO2ACT is equal to "0". If the answer is negative (NO), the present program is immediately terminated, whereas if the answer is affirmative (YES), it is judged that the MO2 sensor 18 has been activated, and therefore the flag FMO2 is set to "1" at a step S56, followed by terminating the program.

Determination as to activation of the RO2 sensor 19 is carried out similarly to the processing of FIG. 6, and if the RO2 sensor 19 has been activated, a flag FRO2 is set to "1".

In this connection, when the engine is under fuel cut, or a predetermined time period has not elapsed since termination of fuel cut, the flag FRO2 remains set to "0" even after the completion of activation of the RO2 sensor 19.

After the execution of the MO2 sensor activation-determining routine shown in FIG. 6, if the answer at the step S31 in FIG. 5 is negative (NO), i.e. if the MO2 sensor 18 has not been activated yet, the program proceeds to a step S32, wherein a timer tmRX is set to a predetermined value T2 (e.g. 0.25 sec.), and then it is determined at a step S33 whether or not a flag FVREF is set to "1" to thereby determine whether or not integral terms VREFIM(n−1) and VREFIR(n−1), referred to hereinafter, have been set.

In the first loop of execution of the routine, the answer at the step S33 is negative (NO), and then the program proceeds to a step S34, wherein a VRREFM table and a VRREFR table stored in the memory means 5*c* (ROM) are retrieved to determine a reference value VRREFM for an output voltage VMO2 from the MO2 sensor 18 and a reference value VRREFR for an output voltage VRO2 from the RO2 sensor 19, respectively.

Figure 7A:
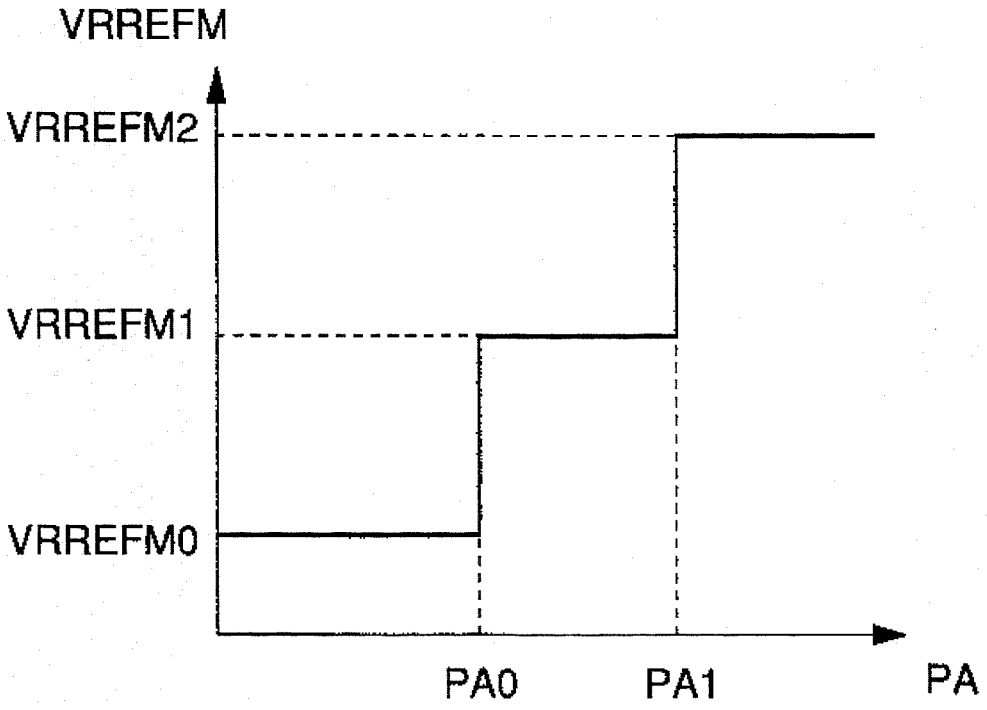
FIG. 7A shows a VRREFM table.
Figure 7B:
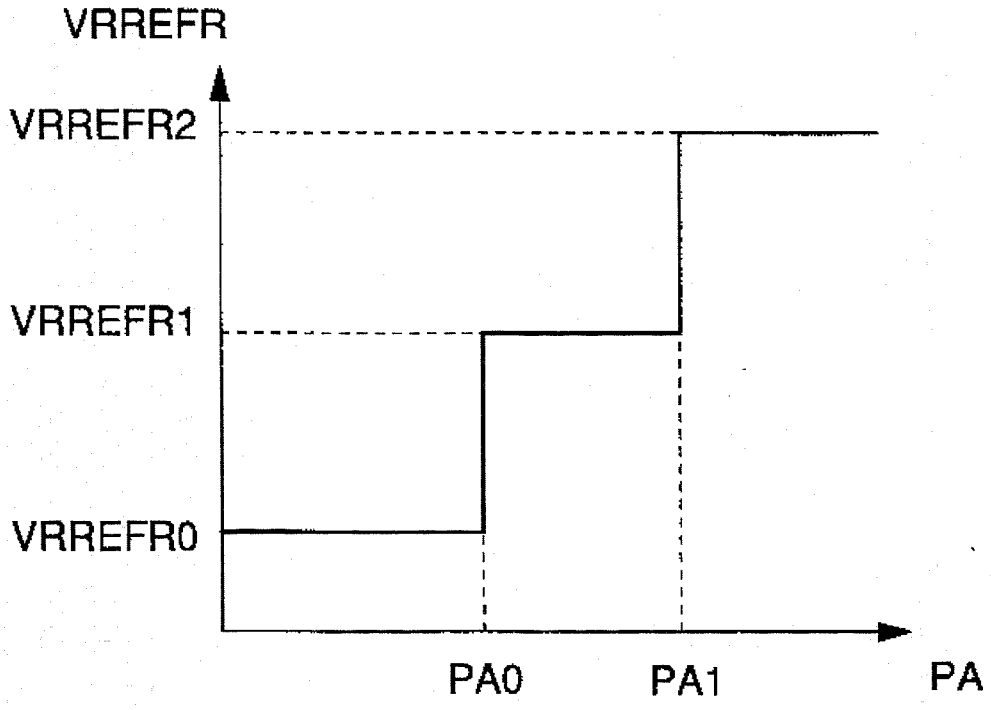
FIG. 7B shows a VRREFR table.

The VRREFM table is set, as shown in FIG. 7A, such that table values VRREFM0 to VRREFM2 are provided in a manner corresponding to predetermined values PA0 to PA1 of the atmospheric pressure PA detected by the PA sensor 18. The reference value VRREFM is determined by retrieving the VRREFM table, or additionally by interpolation, if required. The VRREFR table is set, as shown in FIG. 7B, similarly to the VRREFM table, and the reference value VRREFR is determined by retrieving the VRREFR table. As are clear from FIGS. 7A and 7B, both the reference values VRREFM and VRREFR are set to larger values as the atmospheric pressure PA assumes a higher value.

Then, at a step S35, the integral terms (I term) VREFIM(n−1) and VREFIR(n−1) are set to the reference values VRREFM and VRREFR determined at the step S34, respectively, followed by the program proceeding to a step S36. Thus, the I terms VREFIM(n−1) and VREFIR(n1) are initialized, and then the program proceeds to the step S36. After the I terms have been initialized, the flag FVREF is set to "1", though not shown. When the step S33 is executed in the following loops, the answer at the step S33 is positive (YES), so that the program jumps over the steps S34 and S35 to the step S36.

At the step S36, it is determined whether or not the flag FRO2 is set to "1" to thereby determine whether or not the RO2 sensor 19 has been activated, the engine is under fuel cut, or the aforementioned predetermined time period has not elapsed after the termination of fuel cut. If FRO2≠1 holds, the modified desired air-fuel ratio coefficient KCMDM is set to the desired air-fuel ratio coefficient KCMD as it is, at a step S50, followed by terminating the program.

On the other hand, if FRO2=1 holds, the output VMO2 from the MO2 sensor is replaced by the output VRO2 from the RO2 sensor at a step S37, and then a flag FFBRO2 is set to "0" at a step S47, followed by the program proceeding to a step S49. This processing indicates that when the MO2 sensor 18 is in an abnormal state or has not been activated yet and at the same time the RO2 sensor 19 has been activated, the output VRO2 from the RO2 sensor is substituted for the output VMO2 from the MO2 sensor. On this occasion, a thinning-out variable NIVRM, hereinafter referred to, to be employed during execution of MO2 feedback processing executed at the step S49 may be changed to a predetermined value employed when the VRO2 value is substituted for the VMO2 value. Further, if the FFBRO2 =0 holds, RO2 feedback processing carried out during execution of the MO2 feedback processing at the step S49, hereinafter described, is inhibited (see steps S74 and S76 in FIG. 8). At the step S49, the MO2 feedback processing is executed based on the output VMO2 from the MO2 sensor 18.

Referring again to the step S31, if the answer at the step S31 is affirmative (YES), it is judged that the MO2 sensor 18 has been activated, and then the program proceeds to a step S38, wherein it is determined whether or not the count value of the timer tmRX is equal to "0". If the answer is negative (NO), the program proceeds to the step S33, whereas if the answer is affirmative (YES), it is judged that the MO2 sensor 18 has been activated. Then, the program proceeds to a step S39, wherein it is determined whether or not the desired air-fuel ratio coefficient KCMD set at the step S22 or S23 in the FIG. 4 routine is larger than a predetermined lower limit value KCMDZL (e.g. 0.98). If the answer is negative (NO), which means that the air-fuel ratio of the mixture has been controlled to a value suitable for a so-called "lean burn" condition of the condition, and then the program proceeds to a step S50, whereas if the answer is affirmative (YES), the program proceeds to a step S40, wherein it is determined whether or not the desired air-fuel ratio coefficient KCMD is smaller than a predetermined upper limit value KCMDZH (e.g. 1.13). If the answer is negative (NO), which means that the air-fuel ratio of the mixture has been controlled to a rich value, and then the program proceeds to the step S50, whereas if the answer is affirmative (YES), which means that the air-fuel ratio of the mixture is to be controlled to the stoichiometric value (A/F=14.7), the program proceeds to a step S41, wherein it is determined whether or not the engine is under fuel cut. If the answer is affirmative (YES), the program proceeds to the step S50, whereas if the answer is negative (NO), it is determined at a step S42 whether or not the engine was under fuel cut in the immediately preceding loop. If the answer is affirmative (YES), the count value of a counter NAFC is set to a predetermined value N1 (e.g. 4) at a step S43, and the count value thereof is decremented by "1" at a step S44, followed by the program proceeding to the step S50.

On the other hand, if the answer at the step S42 is negative (NO), the program proceeds to a step S45, wherein it is determined whether or not the count value of the counter NAFC is equal to "0". If the answer is negative (NO), the count value of the counter NAFC is decremented by "1" at the step S44, followed by terminating the program. On the other hand, if the answer is affirmative (YES), it is judged that the fuel supply has been stabilized after termination of fuel cut, and then the program proceeds to a step S46, wherein it is determined whether or not FRO2=1 holds. If FRO2=0 holds, indicating that the RO2 sensor has not been activated yet, the program proceeds to the step S47. On the other hand, if FRO2=1 holds, indicating that the RO2 sensor has been activated, the flag FFBRO2 is set to "1" at a step S48, and then the MO2 feedback processing is carried out at the step S49, followed by the program returning to the main routine of FIG. 2.

Figure 8:
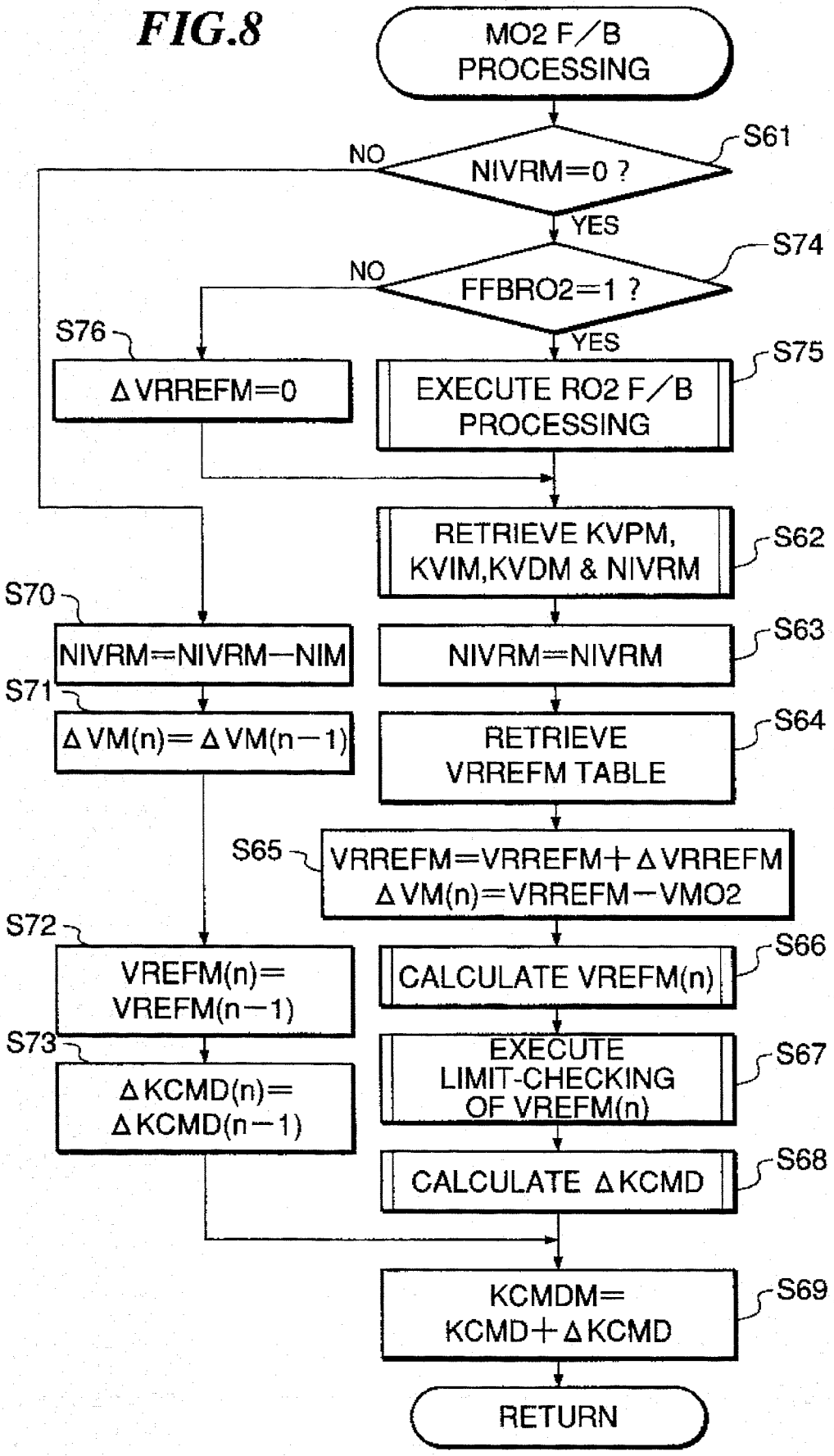
FIG. 8 is a flowchart showing a subroutine for carrying out MO2 feedback control, which is executed by the FIG. 5 routine.

FIG. 8 shows an MO2 feedback processing routine which is executed at the step S49 in the FIG. 5 routine, in synchronism with generation of TDC signal pulses.

First, at a step S61, it is determined whether or not the thinning-out variable NIVRM is equal to "0". The thinning-out variable NIVRM is a variable which is subtracted by a thinning-out TDC number NIM which is determined based on operating conditions of the engine, whenever a TDC signal pulse is generated, as will be described later. In the first loop of execution of the program, the answer is affirmative (YES), and then the program proceeds to a step S74.

If the answer at the step S61 becomes negative (NO) in the following loop, the program proceeds to a step S70.

The thinning-out variable NIVRM is provided in order that the feedback control based on the output from the LAF sensor is carried out as a main control and the feedback based on the output from the MO2 sensor as a subordinate control to prevent occurrence of hunting, etc. and improve the controllability of the air-fuel ratio. The value of the thinning-out variable NIVRM is set depending on the volume of the first catalytic converter 15, the mounting locations of the LAF sensor 17 and the MO2 sensor 18, and operating conditions of the engine. However, if there is no fear that hunting occurs, the present routine may be executed in synchronism with execution of the feedback control based on the output from the LAF sensor.

At the step S74, it is determined whether or not the flag FFBRO2 is set to "1". If FFBRO2=0 holds, a correction value ΔVRREFM for the reference value VRREFM of the MO2 sensor output voltage is set to "0" at a step S76, followed by the program proceeding to a step S62. On the other hand, if FFBRO2=1 holds, the RO2 feedback processing for calculating the correction value ΔVRREFR, based on the output VRO2 from the RO2 sensor is executed at a step S75, followed by the program proceeding to the step S62.

Figure 9A:
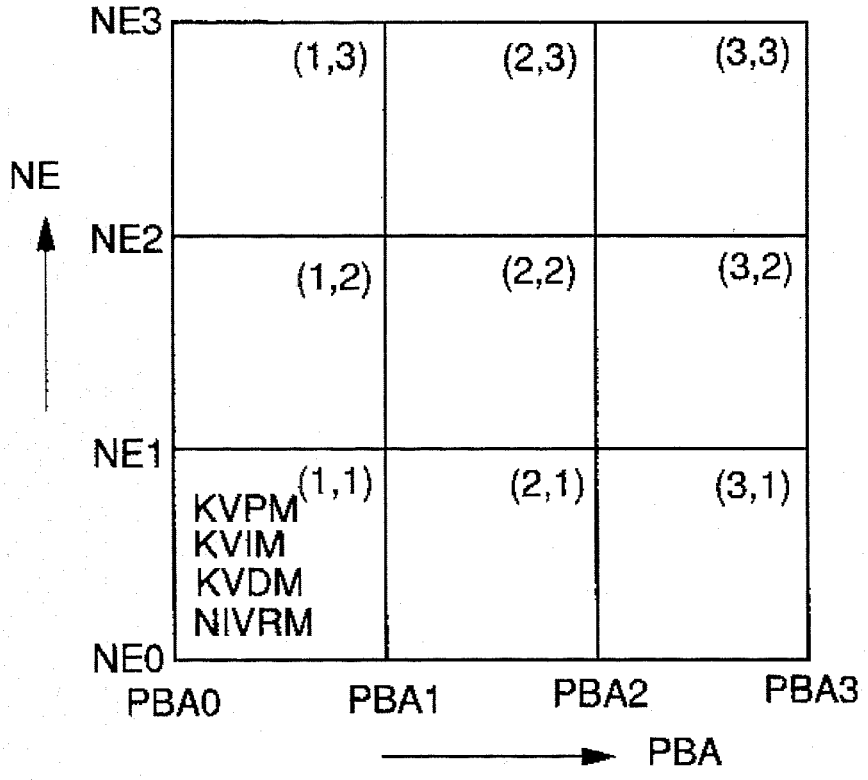
FIG. 9A and 9B show NE-PBA maps which are used for calculating a feedback control constant and a thinning-out variable, respectively.

At the step S62, a KVPM map, a KVIM map, a KVDM map, and an NIVRM map are retrieved to determine a rate of change in the O2 feedback control, i.e. a proportional term (P term) coefficient KVPM, an integral term (I term) coefficient KVIM, a differential term (D term) coefficient KVDM, and the above-mentioned thinning-out variable NIVRM. The KVPM map, the KVIM map, the KVDM map, and the NIVRM map are set, e.g. as shown in FIG. 9A, such that predetermined map values for the respective coefficients KVPM, KVIM and KVDM and the variable NIVRM are provided in a manner corresponding to regions (1,1) to (3,3) defined by predetermined values NE0 to NE3 of the engine rotational speed NE and predetermined values PBA0 to PBA3 of the intake pipe absolute pressure PBA. By retrieving these maps, map values suitable for engine operating conditions are determined, or additionally by interpolation, if required. These KVPM, KVIM, KVDM, and NIVRM maps each consist of a plurality of maps stored in the memory means 5*c* (ROM) to be selected for exclusive use in respective different operating conditions of the engine, such as a normal operating condition, a transient operating condition, and a decelerating condition, depending on which of these operating conditions the engine is operating in, so that the optimum map values can be obtained.

Then, at a step S63, the thinning-out variable NIVRM is set to a value determined at the step S62, and similarly to the step S34 in FIG. 5, a VRREFM table is retrieved to calculate the reference value VRREFM for the MO2 sensor output voltage, at a step S64. Then, at a step S65, a correction is made by adding the correction value ΔVRREFM to the reference value VRREFM, by the use of the following equation (6), and a calculation is made of a value of the difference ΔVM(n) between the reference value VRREFM after the correction and the output voltage VMO2 from the MO2 sensor 18, by the use of the following equation (7):

$$VRREFM=VRREFM+\Delta VRREFM \quad (6)$$

$$\Delta VM(n)=VRREFM-VMO2 \quad (7)$$

Then, at a step S66, desired correction values VREFPM(n), VREFIM(n), and VREFDM(n) for the respective correction terms, i.e. P term, I term, and D term, are calculated by the use of the following equations (8) to (10):

$$VREFPM(n)=\Delta VM(n)\times KVPM \quad \ldots (8)$$

$$VREFIM(n)=VREFIM(n-1)+\Delta VM(n)\times KVIM \quad (9)$$

$$VREFDM(n)=(\Delta VM(n)-\Delta VM(n-1))\times KVDM \quad (10)$$

Then, these desired correction values are added together by the use of the following equation (11) to determine a desired correction value VREFM(n) of the output voltage VMO2 from the MO2 sensor 18 for use in the MO2 feedback control:

$$VREFM(n)=VREFPM(n)+VREFIM(n)+VREFDM(n) \quad (11)$$

Figure 10:
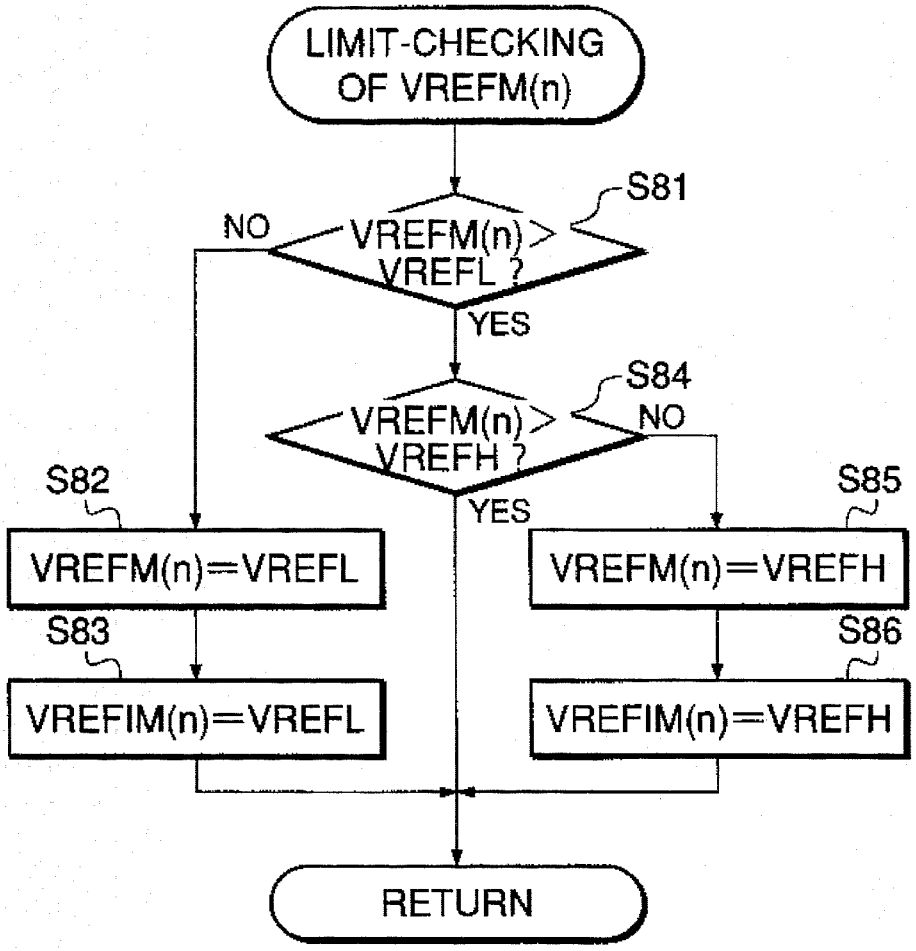
FIG. 10 is a flowchart showing a subroutine for carrying out limit-checking of VREF(n), which is executed by the FIG. 8 routine.

Then, at a step S67, limit-checking of the desired correction value VREFM(n) calculated as above is carried out. FIG. 10 shows a subroutine for carrying out the limit-checking, which is executed in synchronism with generation of TDC signal pulses.

First, at a step S81, it is determined whether or not the desired correction value VREFM(n) is larger than a predetermined lower limit value VREFL (e.g. 0.2 V). If the answer is negative (NO), the desired correction value VREFM(n) and the I term desired correction value VREFIM(n) are set to the predetermined lower limit value VREFL at respective steps S82 and S83, followed by terminating this program.

On the other hand, if the answer at the step S81 is affirmative (YES), it is determined at a step S84 whether or not the desired correction value VREFM(n) is smaller than a predetermined upper limit value VREFH (e.g. 0.8 V). If the answer is affirmative (YES), the desired correction value VREFM(n) falls within a range defined by the predetermined upper and lower limit values VREFH and VREFL, and then the present routine is terminated without modifying the VREFM(n) value determined at the step S68. On the other hand, if the answer at the step S84 is negative (NO), the desired correction value VREFM(n) and the I term desired correction value VREFIM(n) are set to the predetermined upper limit value VREFH at respective steps S85 and S86, followed by terminating this routine.

Following the limit-checking of the desired correction value VREFM(n), the program returns to the step S68 in the FIG. 8 routine, wherein the air-fuel ratio correction value ΔKCMD is calculated.

Figure 11A:
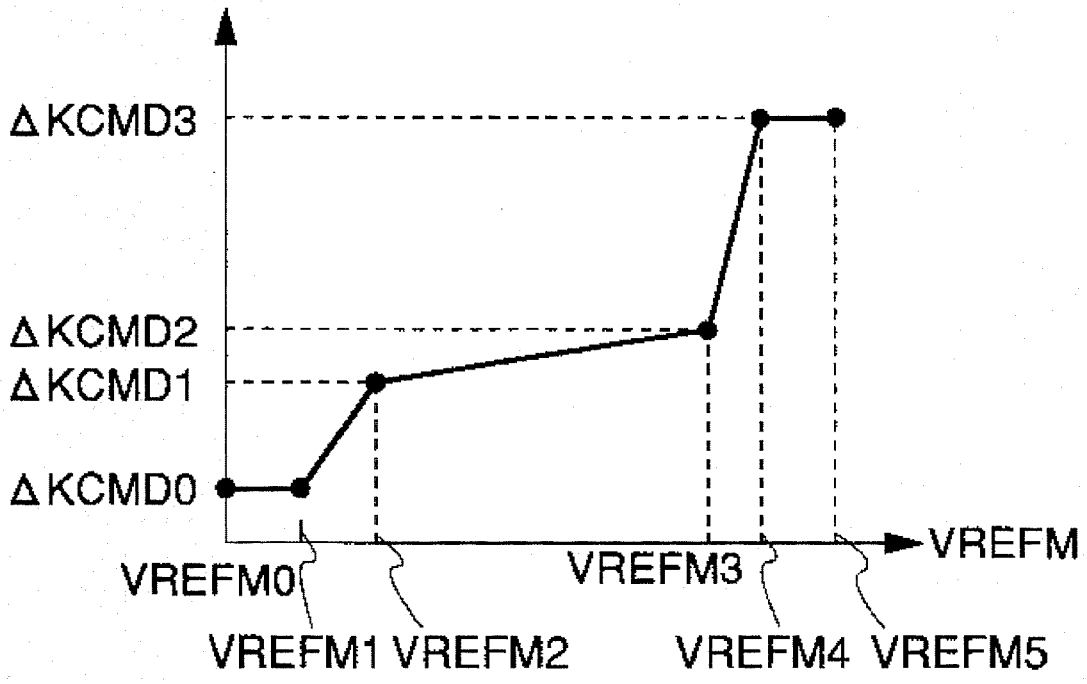
FIG. 11A shows a ΔKCMD table.

The air-fuel ratio correction value ΔKCMD is determined e.g. by retrieving a ΔKCMD table shown in FIG. 11A. The ΔKCMD table is set such that table values ΔKCMD0 to ΔKCMD3 are provided correspondingly to predetermined values VREFM0 to VREFM5 of the desired correction value VREFM. The air-fuel ratio correction value ΔKCMD is determined by retrieving the ΔKCMD table, or additionally by interpolation, if required. As is clear from FIG. 11A, the ΔKCMD value is generally set to a larger value as the VREFM(n) value assumes a larger value. Further, the VREFM value has been subjected to the limit-checking at the step S67, and accordingly the air-fuel ratio correction value ΔKCMD is also set to a value within a range defined by predetermined upper and lower limit values.

Then, at a step S69, the air-fuel ratio correction value ΔKCMD is added to the desired air-fuel ratio coefficient KCMD calculated at the step S22 in FIG. 4, to thereby calculate the modified desired airfuel ratio coefficient KCMDM, followed by terminating the program.

If NIVRM >0 holds at the step S61, the count value of the counter NIVRM is decremented by the thinning-out TDC number NIM, at a step S70, and then the aforementioned difference AVM, the desired correction value VEFM, and the air-fuel ratio correction value ΔKCMD are held at the values assumed in the immediately preceding loop, respectively at steps S71, S72 and S73, followed by the program proceeding to the step S69.

Alternatively, the thinning-out variable NIVRM may be always set to "0" to calculate the modified desired air-fuel ratio coefficient KCMDM by executing the step S62 to S69 in synchronism with generation of TDC signal pulses.

Figure 12:
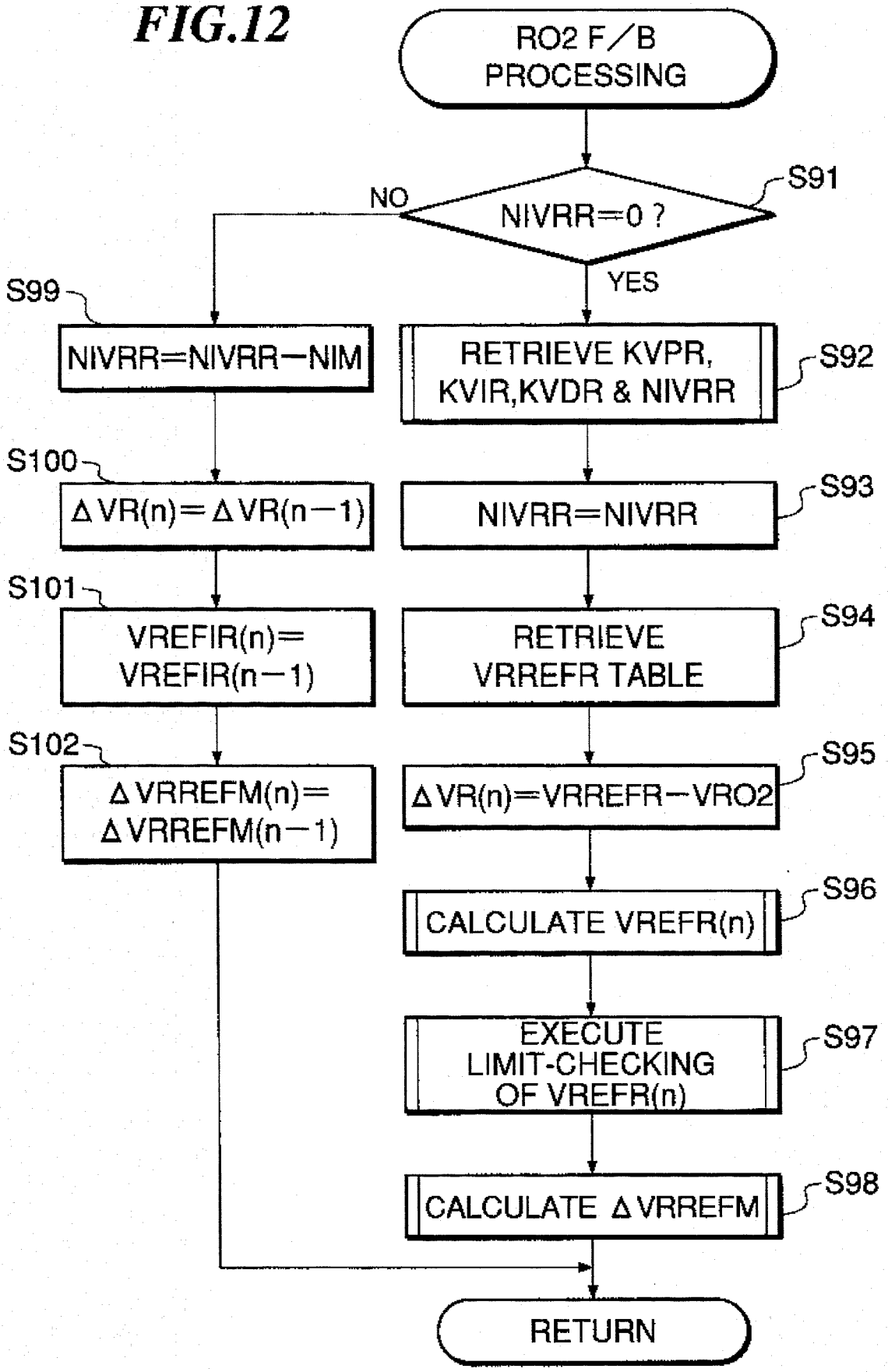
FIG. 12 is a flowchart showing a subroutine for carrying out RO2 feedback control, which is executed by the FIG. 8 routine.

FIG. 12 shows a subroutine for carrying out the RO2 feedback processing which is executed at the step S75 in FIG. 8.

First, at a step S91, it is determined whether or not a thinning-out variable NIVRR is equal to "0". The thinning-out variable NIVRR is similar to the thinning-out variable NIVRM employed in the processing of FIG. 8, which is subtracted by a thinning-out TDC number NIR which is determined based on operating conditions of the engine, whenever a TDC signal pulse is generated. In the first loop of execution of the program, the thinning-out variable NIVRR is equal to "0", i.e. the answer at the step S91 is affirmative (YES), and then the program proceeds to a step S92.

In this respect, the RO2 feedback processing is not carried out during execution of the thinning-out processing (NIVRM≠0) in the MO2 feedback processing and hence the updating rate of the control constant in the RO2 feedback processing is equal to or less than that of the control constant in the MO2 feedback processing, regardless of the set value of the thinning-out variable NIVRR. This is because the O2 processing of FIG. 5 is executed with the MO2 feedback processing as main processing and with the RO2 feedback processing as subordinate processing, so as to prevent occurrence of hunting, etc. and improve the controllability of the air-fuel ratio.

Figure 9B:
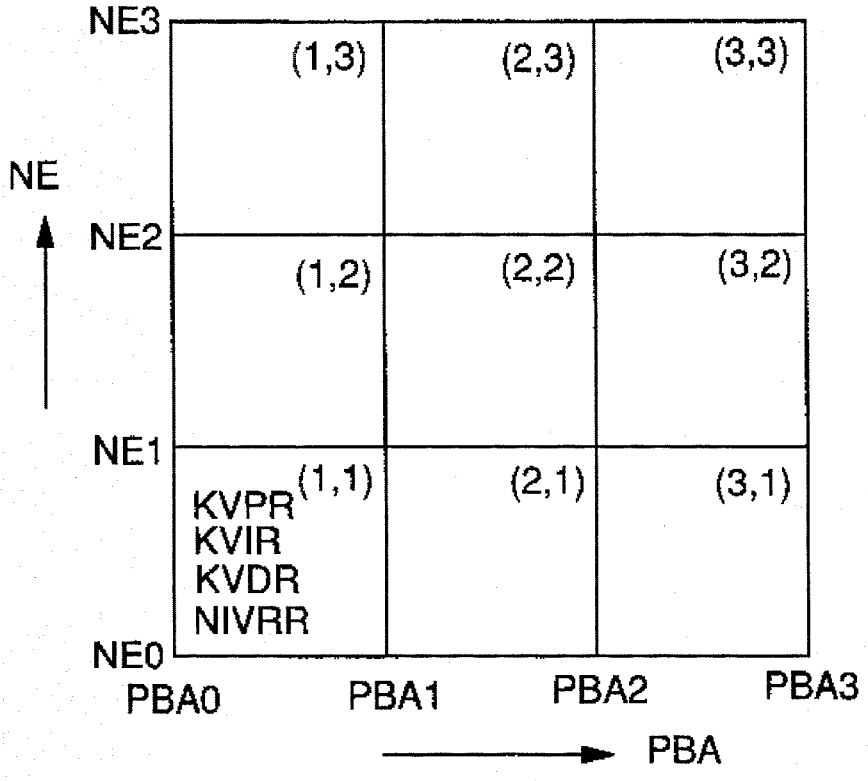

At the step S92, a KVPR map, a KVIR map, a KVDR map, and an NIVRR map are retrieved to determine a rate of change in the O2 feedback control, i.e. a proportional term (P term) coefficient KVPR, an integral term (I term) coefficient KVIR, a differential term (D term) coefficient KVDR, and the aforementioned thinning-out variable NIVRR. The KVPR map, the KVIR map, the KVDR map, and the NIVRR map are set, e.g. as shown in FIG. 9B, such that predetermined map values for the respective coefficients. KVPR, KVIR and KVDR and the variable NIVRR are provided in a manner corresponding to regions (1,1) to (3,3) defined by the predetermined values NE0 to NE3 of the engine rotational speed NE and the predetermined values PBA0 to PBA3 of the intake pipe absolute pressure PBA. By retrieving these maps, map values suitable for engine operating conditions are determined, or additionally by interpolation, if required. These KVPR, KVIR, KVDR, and NIVRR maps each consist of a plurality of maps stored in the memory means 5*c* (ROM) to be selected for exclusive use in respective different operating conditions of the engine, such as a normal operating condition, a transient operating condition, and a decelerating condition, depending on which of these operating conditions the engine is operating in, so that the optimum map values can be obtained.

Then, at a step S93, the thinning-out variable NIVRR is set to a value determined at the step S92, and a VRREFR table is retrieved to calculate the reference value VRREFR of the RO2 sensor output voltage, at a step S94. Then, at a step S95, a calculation is made of a value of the difference ΔVR(n) between the reference value VRREFR and the output voltage VRO2 of the RO2 sensor 19, by the use of the following equation (12):

$$\Delta VR(n)=VRREFR-VRO2 \quad (12)$$

Then, at a step S96, desired correction values VREFPR(n), VREFIR(n), and VREFDR(n) for the respective correction terms, i.e. P term, I term, and D term, are calculated by the use of the following equations (13) to (15):

$$VREFPR(n)=\Delta VR(n)\times KVPR \quad (13)$$

$$VREFIR(n)=VREFIR(n-1)+\Delta VR(n)\times KVIR \quad (14)$$

$$VREFDR(n)=(\Delta VR(n)-\Delta VR(n-1))\times KVDR \quad (15)$$

Then, these desired correction values are added together to calculate the desired correction value VREFR(n) for the RO2 feedback processing, by the use of the following equation (16) to determine the desired correction value VREFM(n) of the output voltage VRO2 from the RO2 sensor 19 for use in the RO2 feedback control:

$$VREFR(n)=VREFPR(n)+VREFIR(n)+VREFDR(n) \quad (16)$$

Then, at a step S97, limit-checking of the desired correction value VREFR(n) is carried out, similarly to the limit-checking of the VREFM value shown in FIG. 10.

After execution of the limit-checking of the RFEFR(n) value, the program proceeds to a step S98, wherein a correction value ΔVRREFM for the reference value VRREFM of the MO2 sensor output, followed by terminating the program.

Figure 11B:
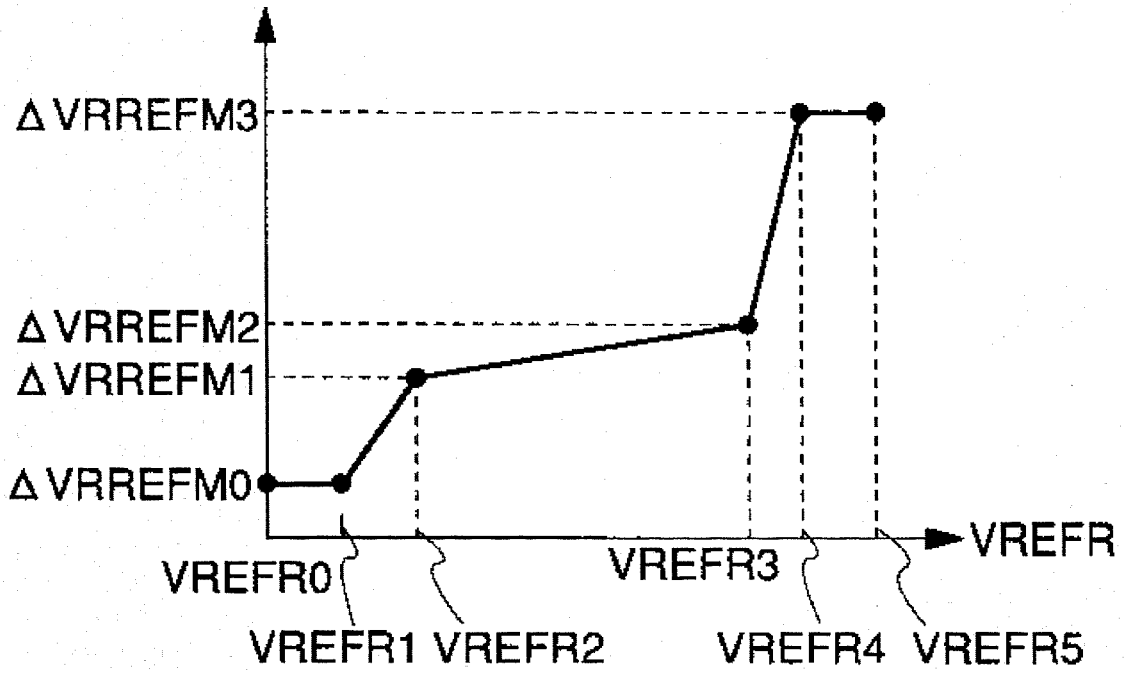
FIG. 11B shows a ΔVRREFM table.

The correction value ΔVRREFM is determined e.g. by retrieving a ΔVRREFM table shown in FIG. 11B. The ΔVRREFM table is set such that table values ΔVRREFM0 to ΔVRREFM3 are provided correspondingly to predetermined values VREFR0 to VREFR5 of the desired correction value VREFR. The correction value ΔVRREFM is determined by retrieving the ΔVRREFM table, or additionally by interpolation, if required. As is clear from FIG. 11B, the ΔVRREFM value is generally set to a larger value as the VREFR(n) value assumes a larger value. Further, the VREFR value has been subjected to the limit-checking at the step S97, and accordingly the air-fuel ratio correction value ΔVRREFM is also set to a value within a range defined by predetermined upper and lower limit values.

If NIVRR >0 holds at the step S91, the count value of the counter NIVRR is decremented by the thinning-out TDC number NIR, at a step S99, and then the aforementioned difference ΔVR, the integral term VREFIR of the desired correction value, and the correction value ΔVRREFM are held at the values assumed in the immediately preceding loops, respectively at steps S100, S101 and S102, followed by terminating the program.

As described above, according to the present embodiment, the RO2 sensor 19 is arranged in the exhaust pipe 14 downstream of the second catalytic converter 16, to correct the reference value VRREFM of the feedback control based on the MO2 sensor output VMO2, based on the output VRO2 from the RO2 sensor 19. As a result, final exhaust emission characteristics of the engine, i.e. exhaust emission characteristics of exhaust gases emitted into the air can be controlled to excellent characteristics for a long term. Further, deterioration of the second catalytic converter 16 can be detected, to thereby prevent degraded exhaust emission characteristics of the engine ascribable to the deterioration of the second catalytic converter 16.

Besides, in the event that the MO2 sensor 18 is in an abnormal state, the MO2 sensor output VMO2 is replaced by the RO2 sensor output VRO2 to calculate the correction value ΔKCMD for the desired air-fuel ratio coefficient KCMD, and therefore, even if the the MO2 18 is abnormal, good exhaust emission characteristics of the engine can be maintained.

Figure 13:
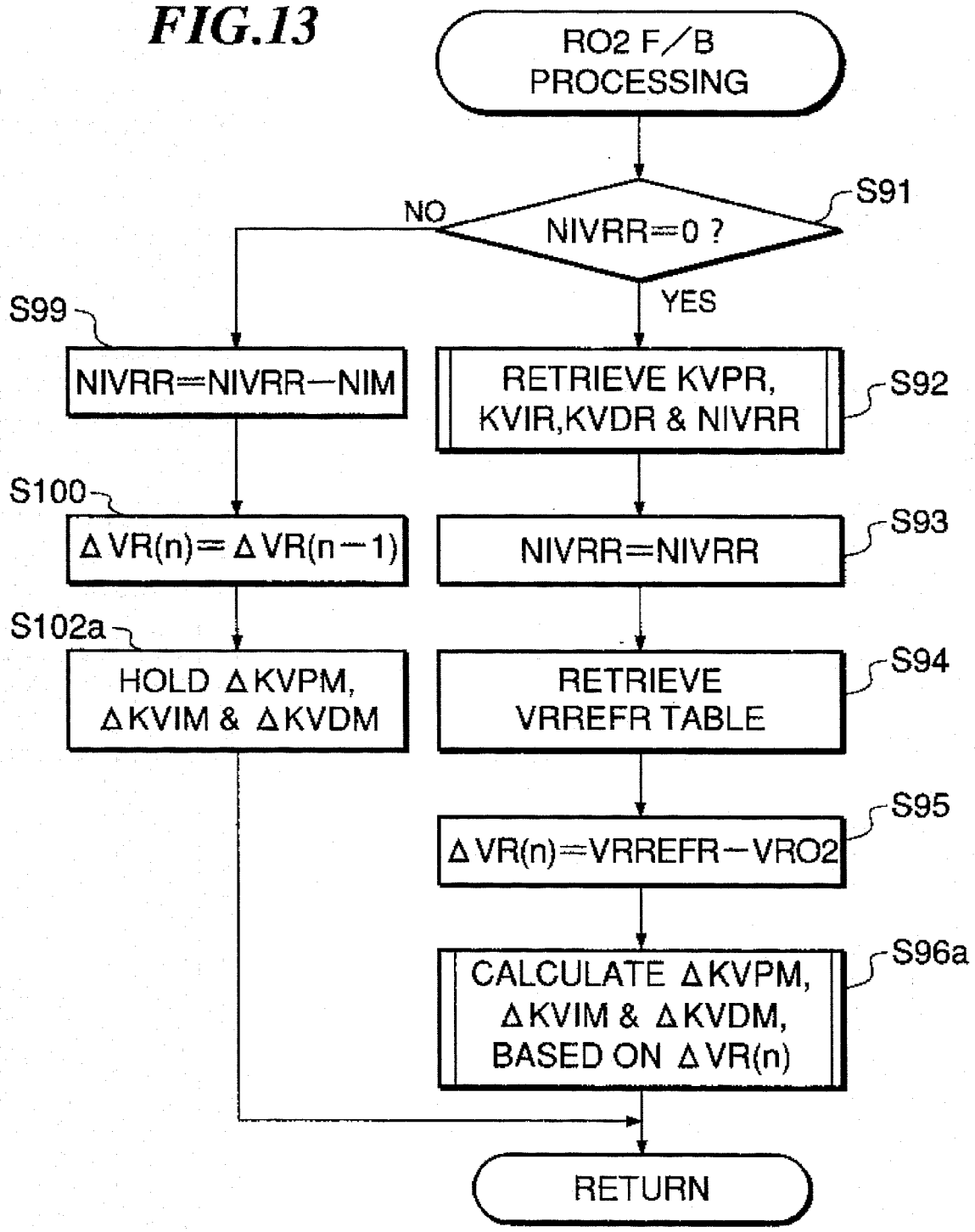
FIG. 13 is a flowchart showing a variation of the subroutine of FIG. 12.

FIG. 13 shows a variation of the above described embodiment, specifically, a variation of the RO2 feedback-processing routine. According to this variation, instead of correcting the reference value VRREFM, based on the RO2 sensor output VRO2, the control gains KVPM (proportional term coefficient), KVIM (integral term coefficient), and KVDM (differential term coefficient) are corrected based on the RO2 sensor output VRO2. The processing of the FIG. 13 routine isS102 identical with the processing of the FIG. 12 routine, except that the steps S96, S97, S98, S101 and S1O2 in FIG. 12 are omitted and steps **S96*a* and 102*a*** are added. Therefore, description of the identical steps is omitted.

Figure 14:
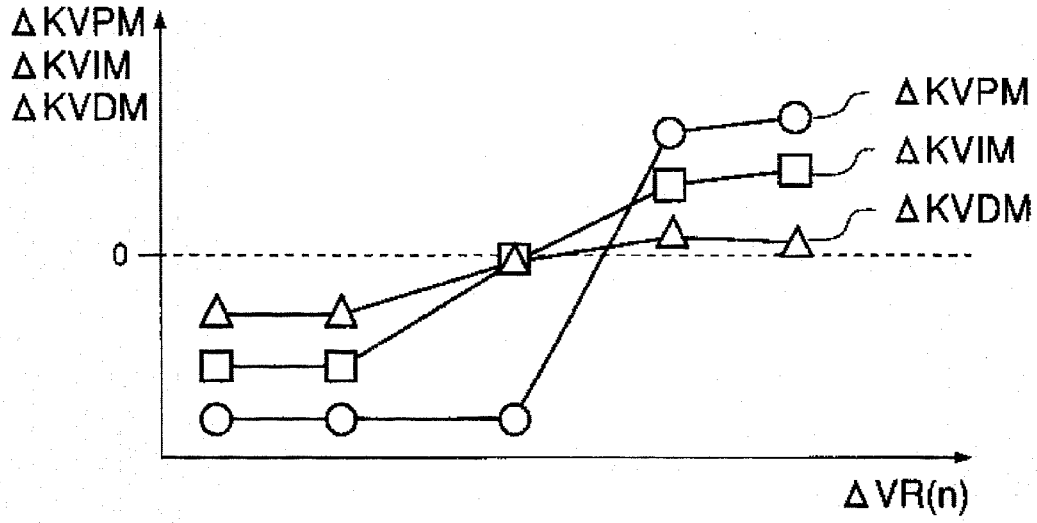
FIG. 14 shows a table which is used for calculating control constants for controlling the M02 feedback control, according to the FIG. 13 variation.

At the step **S96*a*, correction values ΔKVPM, ΔKVIM, and ΔKVDM for the respective control gains are calculated based on the difference ΔVR(n) calculated at the step S95. More specifically, the correction values are determined by retrieving a ΔKVPM table, ΔKVIM table, and a ΔKVDM table shown in FIG. 14**, respectively, according to the difference ΔVR(n), or additionally interpolation, if required. The respective correction values increase as the ΔVR(n) value assumes a larger value, however, the degrees of increase become smaller in the order of ΔKVPM, ΔKVIM, and ΔKVDM.

At the step **S102*a***, the correction values ΔKVPM, ΔKVIM, and ΔKVDM are held at the values assumed in the immediately preceding loop.

According to the present variation, the control gains KVPM, KVIM and KVDM are determined at the step S62 in FIG. 8, and the thus determined values are corrected by the use of the following equations (17) to (19), respectively:

$$KVPM=KVPM+\Delta KVPM \quad (17)$$

$$KVIM=KVIM+\Delta KVIM \quad (18)$$

$$KVDM=KVDM+\Delta KVDM \quad (19)$$

Thus, the control gains KVPM, KVIM and KVDM are controlled in a feedback manner based on the RO2 sensor output VRO2.

According to the present variation as well, the control constant used in the feedback control based on the MO2 sensor output VMO2 can be controlled in a feedback manner based on the RO2 sensor output VRO2, and therefore the same effects achieved by the first embodiment can be achieved.

The invention is not limited to the above described embodiment and variation but various modifications thereof may be possible. For example, in place of correcting the desired air-fuel ratio coefficient KCMD, based on the MO2 sensor output VMO2, the control gains (KLAFFP, KLAFFI, and KLAFFD in the FIG. 3 program) of the feedback control based on the LAF sensor 17 output may be corrected in the same manner as in the FIG. 13 routine.

Further, in place of the thinning-out variables NIVRM and NIVRR, a timer may be employed to correct the desired air-fuel ratio coefficient KCMD or the reference value VRREFM whenever a predetermined time period elapses. Besides, another oxygen concentration sensor similar to the MO2 sensor 18 may be employed in place of the LAF sensor 17, or alternatively another linear oxygen concentration sensor similar to the LAF sensor 17 may be employed in place of the MO2 sensor 18 and/or RO2 sensor 19.

What is claimed is:

1. An air-fuel ratio control system for an internal combustion engine having an exhaust passage, first catalytic converter means arranged in said exhaust passage for purifying exhaust gases emitted from said engine, and second catalytic converter means arranged in said exhaust passage at a location downstream of said first catalytic converter means for purifying said exhaust gases, the system comprising:

first exhaust gas component concentration sensor means arranged in said exhaust passage at a location upstream of said first catalytic converter means for detecting concentration of a specific component in said exhaust gases;

second exhaust gas component concentration sensor means arranged in said exhaust passage at a location downstream of said first catalytic converter means and upstream of said second catalytic converter means for detecting the concentration of said specific component in said exhaust gases;

third exhaust gas component concentration sensor means arranged in said exhaust passage at a location downstream of said second catalytic converter means for detecting the concentration of said specific component in said exhaust gases; and system control means for performing:

a first feedback control function for carrying out feedback control of an air-fuel ratio of a mixture supplied to said engine to a desired air-fuel ratio in response to an output from said first exhaust gas component concentration sensor means;

a second feedback control function for calculating a first feedback control parameter for use in achieving said feedback control by performance of said first feedback control function based on an output from said second exhaust gas component concentration sensor means; and a third feedback control function for calculating a second feedback control parameter for use in said calculation of said first feedback control parameter in the performance of said second feedback control function based on an output from said third exhaust gas component concentration sensor means.

2. An air-fuel ratio control system as claimed in claim 1, wherein said system control means is effective to perform an inhibition condition-detecting function for detecting a predetermined condition in which use of said second exhaust gas component concentration sensor means is to be inhibited, and wherein said second feedback control function is responsive to a result of detection by the performance of said inhibition condition-detecting function that said predetermined condition is fulfilled, for replacing said output from said second exhaust gas component concentration sensor means by said output from said third exhaust gas component concentration sensor means, to calculate said first feedback control parameter, based thereon.

3. An air-fuel ratio control system as claimed in claim 2, wherein said system control means performs an interruption function responsive to said result of detection in the performance of said inhibition condition-detecting function that said predetermined condition is fulfilled, for interrupting performance of said third feedback control function.

4. An air-fuel ratio control system as claimed in claim 3, wherein said predetermined condition comprises at least one of conditions that said second exhaust gas component concentration sensor means is in an abnormal state, said second exhaust gas component concentration sensor means is not activated, and a predetermined time period has not elapsed after said second exhaust gas component concentration sensor means has become activated.

5. An air-fuel ratio control system as claimed in any one of claims 1 to 4, wherein said first feedback control parameter corresponds to said desired air-fuel ratio.

6. An air-fuel ratio control system as claimed in any one of claims 1 to 4, wherein said first feedback control parameter is a feedback gain used in said feedback control by performance of said first feedback control function.

7. An air-fuel ratio control system as claimed in claim 5, wherein said second feedback control parameter is a reference output (VRREFM) to be compared with said output from said second exhaust gas component concentration sensor means to determine said desired air-fuel ratio (KCMDM).

8. An air-fuel ratio control system as claimed in claim 6, wherein said second feedback control parameter is a reference output (VRREFM) to be compared with said output from said second exhaust gas component concentration sensor means to determine said desired air-fuel ratio (KCMDM).

9. An air-fuel ratio control system as claimed in claim 5, wherein said second feedback control parameter is a control gain used in said calculation of said first feedback control parameter in performing said second feedback control function.

10. An air-fuel ratio control system as claimed in claim 6, wherein said second feedback control parameter is a control gain used in said calculation of said first feedback control parameter in performing said second feedback control function.

* * * * *